US006389764B1

(12) United States Patent
Stubler et al.

(10) Patent No.: US 6,389,764 B1
(45) Date of Patent: May 21, 2002

(54) METHOD FOR MAKING PREFABRICATED STRUCTURAL ELEMENTS, AND PRESTRESSED STRUCTURE PRODUCED WITH THE STRUCTURAL

(75) Inventors: Jérôme Stubler, Paris; Jean-François Nieto, Maurepas, both of (FR)

(73) Assignee: Freyssinet International (STUP) (FR)

( * ) Notice: Subject to any disclaimer, the term of this patent is extended or adjusted under 35 U.S.C. 154(b) by 0 days.

(21) Appl. No.: 09/403,909

(22) PCT Filed: Feb. 24, 1999

(86) PCT No.: PCT/FR99/00411

§ 371 Date: Oct. 27, 1999

§ 102(e) Date: Oct. 27, 1999

(87) PCT Pub. No.: WO99/43910

PCT Pub. Date: Sep. 2, 1999

(30) Foreign Application Priority Data

Feb. 27, 1998 (FR) ..... 98 02406

(51) Int. Cl.[7] ..... E04C 2/52

(52) U.S. Cl. ..... 52/220.8; 52/223.13; 52/223.7

(58) Field of Search ..... 52/220.8, 223.11, 52/223.14, 223.13, 223.7, 223.9; 264/31, 32, 35, 271.1

(56) References Cited

U.S. PATENT DOCUMENTS 3,744,200 A * 7/1973 Rice ..... 52/223.7
3,950,905 A * 4/1976 Jeter ..... 52/223.13 X
4,174,366 A * 11/1979 Schneider ..... 52/223.14 X
4,294,051 A * 10/1981 Hughes, Jr. ..... 52/223.7 X
4,509,305 A * 4/1985 Guinard ..... 52/223.11
5,272,851 A * 12/1993 De La Fuente ..... 52/223.13 X

FOREIGN PATENT DOCUMENTS

| | | |
|---|---|---|
| DE | 1559491 | 6/1970 |
| DE | 29601029 | 5/1996 |
| EP | 0348870 | 1/1990 |
| EP | 0462350 | 12/1991 |
| FR | 1514340 | 5/1968 |
| FR | 2569439 | 10/1987 |

OTHER PUBLICATIONS

Mathivat J. et al., <<Evolution et récents développements des ponts à Voussoirs préfabriqués>>, Annales de L'Institut Technique du Bâtiment et des Travaux Publics, Sep. 1976, No. 342, pp. 21–32.

* cited by examiner

*Primary Examiner*—Peter M. Cuomo
*Assistant Examiner*—Stephen Vu
(74) *Attorney, Agent, or Firm*—Cantor Colburn LLP

(57) ABSTRACT

A process of manufacturing concrete construction elements is provided. A first sheath is placed in a first mold, the first sheath connected at an end to a first sleeve applied against a wall of the mold, the sleeve engaging a positioning boss placed on the wall. Concrete is poured into the first mold and set to obtain the first element. The first element is extracted from the first mold and includes a contact face shaped by the wall. A second sheath is placed in a second mold, the second mold having one side formed by the contact face. The second sheath includes an end connected to a second sleeve held in position relative to the first sleeve by a positioning joint. Concrete is poured into the second mold and set to obtain a second element. The second element is extracted from the second mold by disengaging the positioning joint.

15 Claims, 4 Drawing Sheets

FIG.4.
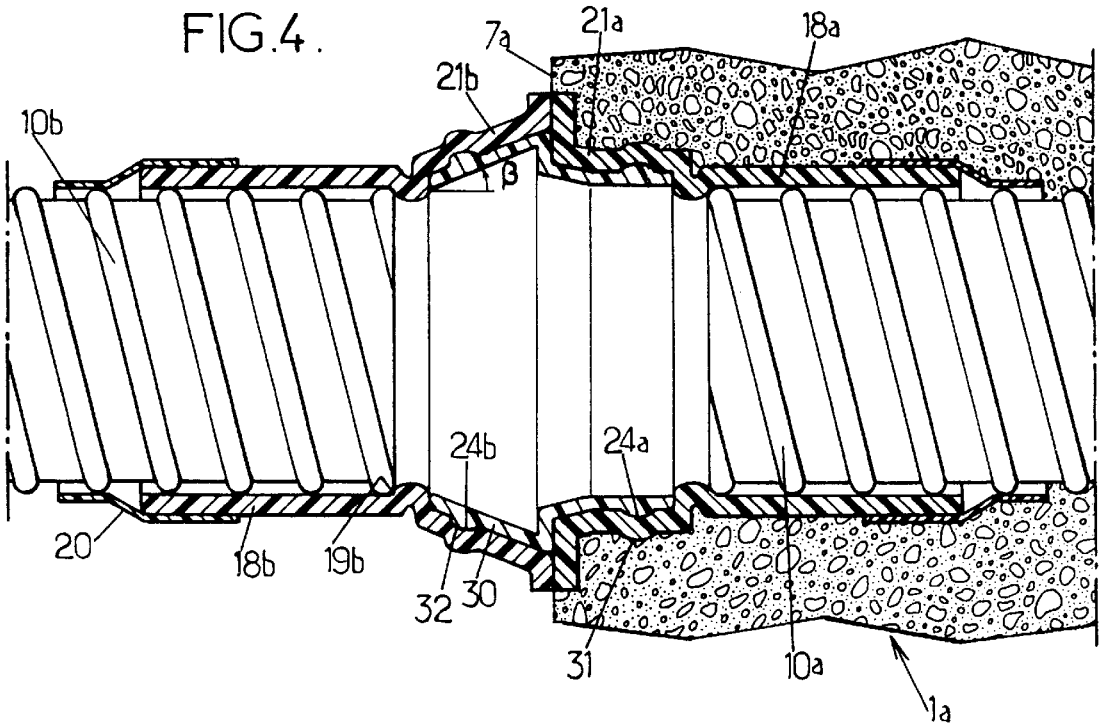
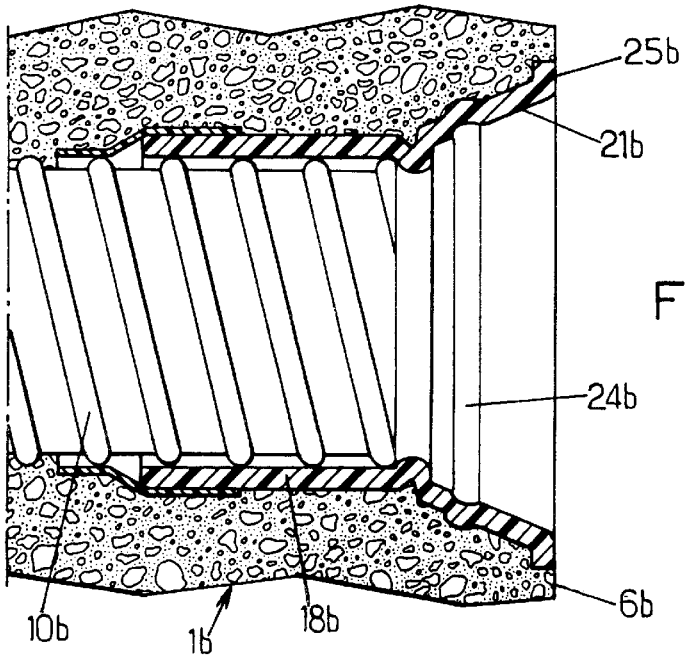
FIG.5.

METHOD FOR MAKING PREFABRICATED STRUCTURAL ELEMENTS, AND PRESTRESSED STRUCTURE PRODUCED WITH THE STRUCTURAL

BACKGROUND OF THE INVENTION

The present invention relates to the construction of pre-stressed structures from prefabricated matched concrete elements.

The invention applies in particular, but not exclusively, to bridges built by cantilevered construction with prefabricated segments having matched coupling surfaces (see for example the article: "Evolution et recents developpements des ponts a voussoirs prefabriques" ("Evolution and recent developments of bridges made of prefabricated segments") by Jacques Mathivat, Annales de l'lnstitut Technique du Batiment et des Travaux Publics, Supplement to No. 342, September 1976, pages 21—32, or the patent application EP-A-0 462 350).

In this technique, the successively assembled elements (segments) of the bridge are manufactured one after the other, the front face of the element n serving to delimit the rear side of the manufacturing mold of the element n+1. This guarantees the matching of the adjacent faces of the elements to be assembled. These faces are glued one on the other during the placing of the element n+1 on the building site. Complementary raised parts are usually provided on these faces to facilitate their mutual positioning and to help to support the element n+1 before its definitive fixing.

These structures are frequently subjected to a longitudinal pre-stress by means of pre-stressing cables threaded in sheaths embedded in the concrete of several successive elements.

Carrying out this pre-stress is a delicate operation.

The positioning of the sheath sections in the elements must be very precise so that the pre-stressing cables can be threaded without difficulty.

To guarantee the sealing of the sheath at the interfaces between elements is the most difficult. This sealing is necessary to ensure the durability of the pre-stressing subjected to the risks of infiltrations at the level of the joint between the elements. The joint can be made according to two processes: "dry joint" when the concrete faces are placed side by side without any interface product; or "glued joint" when an interface adhesive is placed at the level of the joint. In this second case, the sealing also fulfils the necessity of avoiding the epoxy or similar adhesive placed between the elements being able to penetrate into the sheaths and hinder the introduction of the cables. On the other hand, the sheaths are generally injected with a filling product (cement grouting, grease, wax, resin, etc) serving in particular to protect the cables against corrosion. This product must not escape to the outside of the sheath during the injection.

Certain zones of the structure may have a rather large density of sheaths, and there is not the assurance that the epoxy adhesive will achieve the sealing between these sheaths. The result is the grave risk that grouting injected under pressure into the sheath may infiltrate into one or several neighboring sheaths, where the injection then becomes very difficult, or even impossible.

In general, pneumatic tests are carried out to check the sealing of the pre-stress sheaths before installing the cables and injecting the grouting. If leaks are detected between some sheaths, it is necessary to inject the grouting very carefully in a way to attempt to have a single advancing grouting front in these different sheaths. The resulting injection procedures are extremely complicated and very difficult to control.

The solutions consisting in interposing O rings around the sheaths between the interconnected faces of the elements are not reliable in terms of sealing, these seals being able to be displaced during the positioning of the element n+1.

The patent application FR-A-2 596 439 describes a connection device between pre-stress sheath sections, comprising a cylindrical sleeve engaged between the mouths of two contiguous sections to ensure the continuity of the sheath, and a resilient seal surrounding the cylindrical sleeve to carry out the sealing and to compensate for the positioning irregularities of the units and their dimensional differences.

It has also been proposed to introduce a longitudinally pleated sleeve into the sheath after the gluing, this sleeve being brought at the level of the previously assembled contact surfaces then expanded with the aid of a pneumatic device in order to be glued to the internal wall of the sheath by means of an adhesive placed at the bottom of the pleats. This method involves a very complex implementation, moreover impossible when the sheaths are not rectilinear. Moreover, it does not prevent the infiltrations of adhesive into the sheath during the assembly of the elements.

An object of the present invention is to propose a simple and efficient solution to the problems encountered when carrying out the pre-stressing of structures constructed from matched prefabricated elements.

SUMMARY OF THE INVENTION

The invention thus proposes a process of manufacturing concrete construction elements including at least first and second matched elements, the process including the steps of:

- placing in a mold at least one first pre-stress sheath section having an end connected to a first sleeve applied against a wall of the mold, the first sleeve having an internal shape engaging a positioning boss placed on said wall;
- pouring concrete into said mold so as to obtain the first element after setting of the concrete;
- extracting from the mold the first element, one contact face of which has been shaped by said wall;
- constructing a second mold one side of which consists of said contact face of the first element;
- placing in the second mold at least one second pre-stress sheath section having an end connected to a second sleeve held in position relative to the first sleeve by means of a positioning joint resiliently held in at least one of the first and second sleeves;
- pouring concrete into the second mold so as to obtain the second element after setting of the concrete; and
- extracting the second element from the second mold, by disengaging the positioning joint from at least one of the first and second sleeves.

The positioning joint may be the same piece as the joint which will achieve the sealing between the sleeves after the definitive assembly of the elements. In this case, the joint can be left in place in one or other of the two sleeves during the storage of the elements.

The sleeves and the joint ensure a precise and correct positioning of each section of sheath in each element, as well as the good alignment of successive sections. The dimensional differences to be compensated are thus minimized.

During the assembly of two consecutive elements, the sealing joints, with which the sleeves terminating the sheath sections on the face of one of the elements are provided, engage the sleeves ending the corresponding sheath sections of the other element. This engagement provides the sealing of the sheath in relation to the adhesive, with which one of the complementary faces is generally coated. It ensures moreover the absence of communication with the outside or between neighboring sheaths during injection of the cement grouting or other filling product into the sheaths.

The sealing joint may be integral with one of the two sleeves. But it is preferably fixed in a removable manner on one of the two sleeves, for example by screwing or by resilient fitting.

In preferred embodiments, the process of manufacturing concrete construction elements according to the invention has one or other of the following features:

- the positioning boss may be provided with resilient coupling means which engage with an annular groove present in the internal shape of the first sleeve in order to hold it in a removable manner in the mold;
- the sleeve in which the positioning joint is resiliently held may have an angular opening of at least 30 degrees;
- the positioning joint may be resiliently held in each one of the first and second sleeves;
- the positioning joint may be screwed in one of the first and second sleeves;
- when a feature according to one of the two previous paragraphs is provided, the positioning joint may have an orifice coaxial with the sleeves, extending therethrough, said orifice having a cross-section at least equal to the internal cross-section of the first and second sheath sections, and in this case the positioning joint is left in place in the first or the second sleeve after the extraction of the second element.

The invention is also intended for a construction work comprising an assembly of prefabricated elements of a series of elements such as defined above, the contact faces of the matched elements being applied one against the other so that the sheath sections are placed in the extension one of the other to form completed sheaths, with joints engaged in the sleeves in order to connect in a sealed manner the adjacent sheath sections, and wherein pre-stressing cables and a filling product occupy the interior of the sheaths.

Other features and advantages of the present invention will emerge in the description below of non-restrictive embodiment examples, by reference to the appended drawings, in which:

BRIEF DESCRIPTION OF THE DRAWINGS

FIG. 4 is a section view illustrating the placing of a second sheath section in a fabrication mold of a second element;

FIG. 5 is a partial section view of the second fabricated element;

DESCRIPTION OF PREFERRED EMBODIMENTS

The invention is described below in its application to bridges made of prefabricated segments with matched coupling surfaces.

Figure 1:
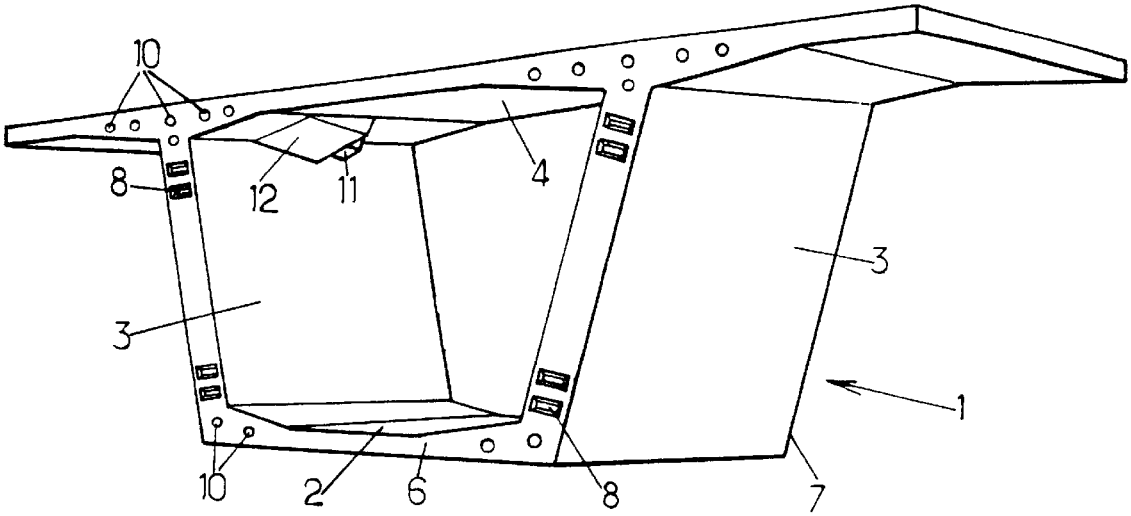
FIG. 1 is a perspective view of a prefabricated segment to which the present invention can be applied.

Such a segment 1 is shown in FIG. 1. The element 1 has the general form of a caisson delimited below by a base 2, laterally by two symmetrically inclined walls 3, and above by a deck 4 laterally extended beyond the walls 3 in order to define the width of the bridge.

In the longitudinal direction, the element 1 is delimited by a rear face 6 and a substantially parallel front face 7. The rear face 6 is intended to come into contact against the front face, of complementary shape, of the previous element installed on the structure during construction (in the case of the first element installed on a bridge pier, the complementary face belongs to this pier). Likewise, the front face 7 of the element 1 is intended to receive the rear face of the next element which is to be placed.

Figure 1A:
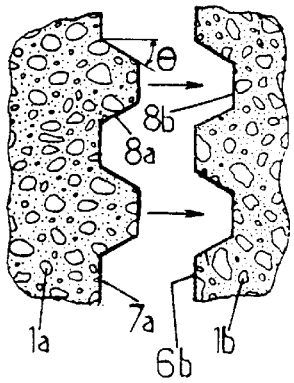
FIG. 1A is a partial lateral view illustrating the assembly of two consecutie segments.

The contact faces of complementary shapes of the adjacent elements are provided with raised parts 8*a*, 8*b* ensuring a good relative positioning of the elements when they are brought together. In the particular example shown in FIGS. 1 and 1A, these raised parts are located on the end faces of the lateral walls 3 of the elements, and have the shape of trapezoidal profile projections 8*a* made during the molding on the front face 7*a* of the element 1*a*, and on the other hand by complementary trapezoidal profile recesses 8, 8*b* made during the molding on the rear face 6, 6*b* of the element 1,1*b*.

When an assembly adhesive is used, this is for example an epoxy resin with which one or other of the two complementary faces is coated before assembly. After its placing, the element 1, 1*b* is clamped against the previous element 1*a*, so that the trapezoidal profile recesses 8, 8*b* formed on its rear face 6, 6*b* engage the complementary projections 8*a* of the front face 7*a* of the previous element 1*a* in order to support it before setting of the adhesive. After the setting of the adhesive the projecting parts take up at least partly the shearing force exerted at the level of the joint by the structure load.

The element 1 comprises a number of longitudinal sheath sections 10, intended to receive pre-stressing cables. These cables are anchored on the structure at their ends by means of appropriate anchoring devices. Some of these anchoring devices 11 can possibly be placed on bosses 12 provided inside the caisson shape of the element. The sheath sections 10 emerge on the rear face 6 and/or on the front face 7 of the element. It is important to ensure the continuity and the sealing of each pre-stress sheath at the level of the contact faces of the adjacent elements. To do that, according to the invention, connection pieces are used (sleeves and joints) which are described below.

After placing the element, it is clamped against the previous element, at least until the setting of the assembly adhesive. This clamping can be carried out by placing certain pre-stressing cables if anchoring devices 11 orientated to the rear are provided on the element. Otherwise, or as a complement, external actuators are used to clamp the elements against each other.

Once the successive sections of a complete sheath have been assembled, the sealing of this sheath is verified by means of a pneumatic device. It is then possible to thread the strands of the pre-stressing cable into the sheath, to tension them, to anchor them at their ends, then to inject a filling product such as a cement grout into the sheath in order to fill in the voids and protect the cables against corrosion.

The successive elements 1 are prefabricated in molded concrete. FIGS. 2 to 5 illustrate the prefabrication of two consecutive elements 1*a*, 1*b*.

To fabricate the first element 1*a*, a mold having the required shape is used. On the front side of the element, the mold is delimited by a metal wall 15 (FIG. 2) of general plane shape, having recesses complementary to the projections 8*a* in the specified places.

Positioning bosses 16 are fixed on the internal side of the wall 15, for example by welding. These bosses 16, of general cylindrical shape, serve to install the sheath sections 10*a* of the first element 1*a* in the mold.

The front end of each sheath section 10*a* is engaged in a sleeve 18*a* up to an internal stop 19*a* provided in this sleeve. The sealing between the sheath section 10*a* and the sleeve 18*a* is conventionally carried out by means of a thermo-retractable sheath or by an adhesive tape 20.

The sleeve 18*a* is in a material sufficiently rigid so as not to deform when the concrete is poured into the mold, for example a plastic material such as a high density polyethylene.

Beyond the stop 19*a*, the sleeve 18*a* has a widened portion 21*a* with a shape adapted to engage on the positioning boss 16. The sleeve 18*a* connected to the sheath section 10*a* is engaged on the boss 16 by an operator. The sleeve 18*a* is thus positioned with precision against the wall 15 of the mold, and held in this place by resilient anchoring means provided on the positioning boss 16. These means can include a resilient part 22 housed in an annular groove 23 provided in the outside of the cylindrical shape of the positioning boss 16, and engaging with another annular groove 24*a* provided in the internal shape of the widened portion 21*a* of the sleeve 18*a*. The part 22 consists for example of a flat coiled spring being able to be flattened when it is compressed radially.

Figure 3:
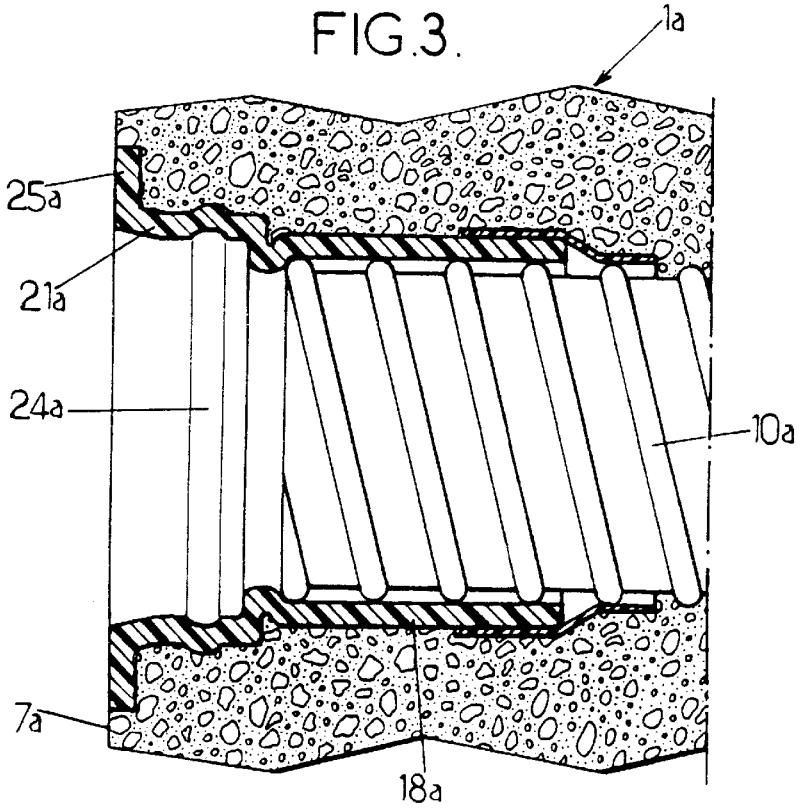
FIG. 3 is a partial section view of the first fabricated element.

Once the different sheath sections 10*a* of the element 1*a* have been installed in that way, the concrete is poured into the mold. After its setting, the element 1*a* can be extracted from the mold, the wall 15 being withdrawn by pulling out the positioning bosses 16 from the sleeves 18*a*. This wall 15 releases the front face 7*a* of the element. The front end 25*a* of the sleeve 18*a*, which was applied against the wall 15, is in the plane of the front face 7*a*. The constitution of the element 1*a* near the front end of a sheath section 10*a* is shown in FIG. 3.

The front face 7*a* of the element 1*a* serves to delimit the rear side of the fabrication mold of the following element 1*b* (FIG. 4).

To mount the sheath sections 10*b* of the element 1*b*, a positioning joint is engaged in the widened portion 21*a* of each sleeve 18*a* appearing on the front face 7*a* of the first element 1*a*.

This joint 30 can be made in a material more flexible than the sleeve 18*a*, for example in a low density polyethylene having a modulus of elasticity of the order of 500 $N/mm^2$.

A rear part of the joint 30 has an external shape corresponding to the internal shape of the widened portion 21*a* of the sleeve 18*a*, with in particular an annular ridge 31 complementary to the annular groove 24*a* of the sleeve 18*a*. This rear part of the joint 30 is pushed into the widened portion 21*a* of the sleeve 18*a*, where it is held in place by the engagement of the ridge 31 with the annular groove 24*a*.

The other (front) part of the joint 30 projects beyond the front face 7*a* of the element 1*a*. This front part can have an external contour of general frusto-conical shape provided with another annular ridge 32. Preferably, this frusto-conical shape, which converges away from the element, has a half angle β less than the angle θ formed by the sides of the trapezoidal profile of the raised parts 8*a*, 8*b* with the perpendicular direction of the end surfaces 7*a*, 6*b*, which ensures that the part 30 is not damaged during handling of the element 1*b*.

Each sheath section 10*b* of the second element 1*b* is engaged in another sleeve 18*b* up to an internal stop 19*b*, with a thermo-retractable sheath or an adhesive tape 20 to ensure the sealing between the sheath and the sleeve. Away from the sheath section 10*b*, the sleeve 18*b* has a widened portion 21*b* the internal shape of which is complementary to the external shape of the front projecting part of the positioning joint 30. In particular, this widened portion 21*b* has an internal annular groove 24*b* which engages with the annular ridge 32 of the positioning joint to hold the sleeve 18*b* in place against the sleeve 18*a* in the fabrication mold of the second element (FIG. 4).

Once all the sheath sections 10*b* of the second element have been placed in the mold by means of the joints 30 and the sleeves 18*b*, the concrete is poured into this mold to make the second element. After setting of the concrete and extraction from the mold, by pulling out the joints 30 away from the widened portions 21*b* of the sleeves 18*b*, the second element 1*b* has the configuration shown in FIG. 5 near the rear end of the sheath section 10*b*, the sleeve 18*b* having its rear end 25*b* in the plane of the rear face 6*b* of the element.

The fact that the positioning joint 30 stays in place on the first element 1*a* rather than on the second element 1*b* results from the angular opening of the widened portion 21*b* of the sleeve 18*b*, which is larger than the angular opening of the widened portion 21*a* of the other sleeve 18*a*.

The positioning joint 30 staying on the first element 1*a* will serve as a sealing joint between the corresponding sheath sections 10*a*, 10*b* during the assembly of the elements on the building site. This joint 30 is thus provided with an orifice coaxial with the sheath sections 10*a*, 10*b*, the cross-section of which is preferably at least equal to the internal cross-section of these sheath sections. Because of its external shape complementary to the housing defined between the widened portions 21*a*, 21*b* of the sleeves, of the relative elasticity of its material and of its constant and relatively small thickness, the joint 30 is subjected to a certain radial compression which ensures the sealing of the sheath at the level of the interface between the elements 1*a*, 1*b*.

The angular opening of the widened portion 21*b* of the sleeve 18*b*, which corresponds substantially to the angle 2β of the front frusto-conical part of the joint 30 is preferably greater than 30 degrees. Because of this arrangement, the joint 30 can easily penetrate into its housing when the second element 1*b* is brought to the first element 1*a*.

If the front projecting part of the joint 30 is damaged during the storage of the elements, this joint 30 can be pulled from the sleeve 18*a* in which it is resiliently held, and replaced by another joint.

Alternatively, the positioning joint 30 used during the prefabrication of the elements 1*a*, 1*b* could be separate from the sealing joint installed for the definitive assembly of the elements, provided that the joint 30 correctly positions the sleeve 18*b* in the fabrication mold of the second element.

In another alternative embodiment, the positioning and sealing joint could be integral with one of the two sleeves. For example, the first element could be fabricated in the way illustrated by reference to FIGS. 2 and 3 (but preferably with sleeves 18*a* the widened portion 21*a* of which would have a greater angular opening), and the second sleeves joined to the rear ends of the sheath sections 10*b* could be extended by a more flexible rear part the external contour of which would be complementary to the internal shape of the widened portion 21. In order for this rear part to be made more flexible, its thickness can be reduced relative to the rest of the sleeve, and/or this sleeve can be made from two materials having different moduli of elasticity. With such an embodiment, the number of required pieces to achieve the sealing is minimized.

In other embodiments (FIG. 6), the positioning and/or sealing joint is screwed into one or other of the two sleeves.

Figure 6:
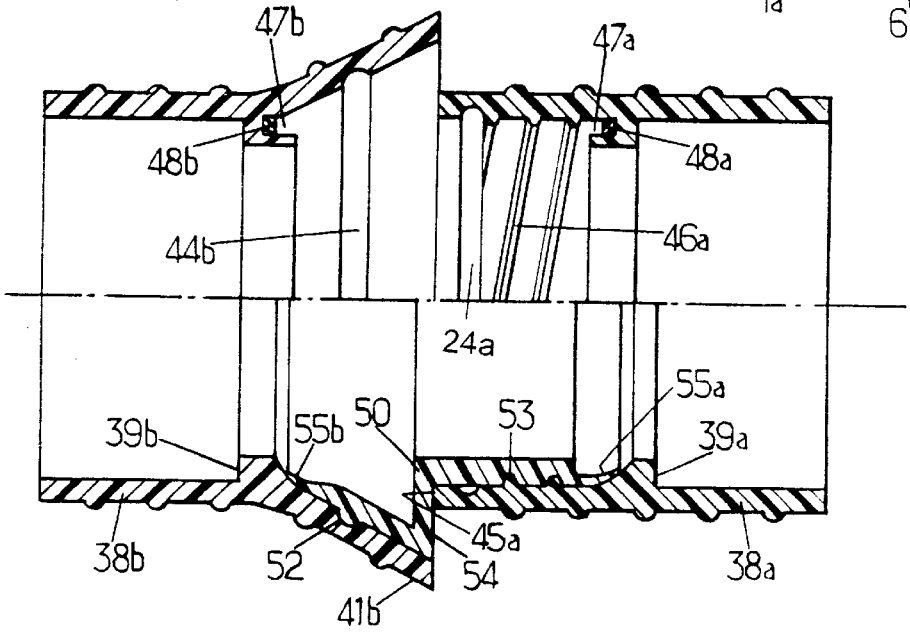
FIG. 6 is a section view showing two alternative embodiments of the junction means of two pre-stress sheath sections.
Figure 2:
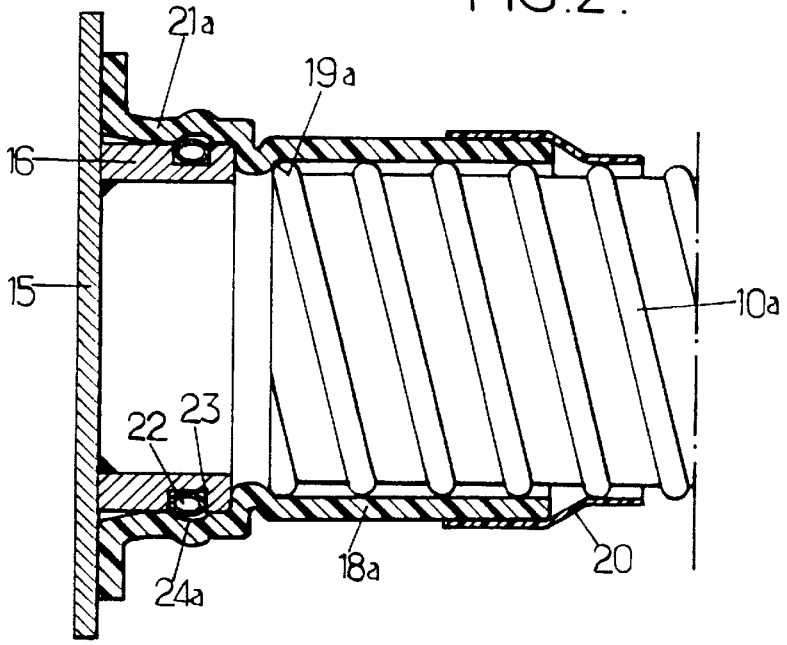
FIG. 2 is a section view illustrating the placing of a sheath section in a manufacturing mold of a first element.

In the embodiment illustrated in FIG. 6, the positioning and sealing joint 50 has a cylindrical rear part engaged in the sleeve 38*a* to which is connected the sheath section 10*a* of the first element, and a frusto-conical front part provided with an external annular ridge 52. Between these two parts, the joint 50 has a transverse shoulder 54 which abuts against the front end 45*a* of the sleeve 38*a* and against the front face of the first element. The cylindrical part of the joint 50 is provided with a female thread 53 complementary to a male thread 46*a* provided inside the sleeve 18*a*. In this way, the joint 50 can be screwed into the first sleeve 38*a*, the threads contributing to the sealing.

In the frusto-conical part of the joint 50, the sealing results from the engagement of the ridge 52 in the groove 44*b* provided inside the widened portion 41*b* of the second sleeve 38*b*.

In the example shown in the lower part of FIG. 6, the sealing is enhanced by the fact that the two ends of the joint 50 have thinned lips 55*a*, 55*b* which bend resiliently inwards when the joint 50 is installed in the sleeves 38*a*, 38*b*. This bending can be caused by curved internal surfaces provided in the sleeves 38*a*, 38*b*, at the back of the stops 39*a*, 39*b* receiving respectively the ends of the sheath sections.

In the alternative embodiment shown in the upper part of FIG. 6, an annular housing 47*a*, 47*b*, open to the front side, is provided in the internal shape of the sleeve 38*a*, 38*b*, at the back of the stop 39*a*, 39*b*. The two ends of the positioning and sealing joint then compress flat sealing joints 48*a*, 48*b*, placed in the housing 47*a*, 47*b*.

Figure 7:
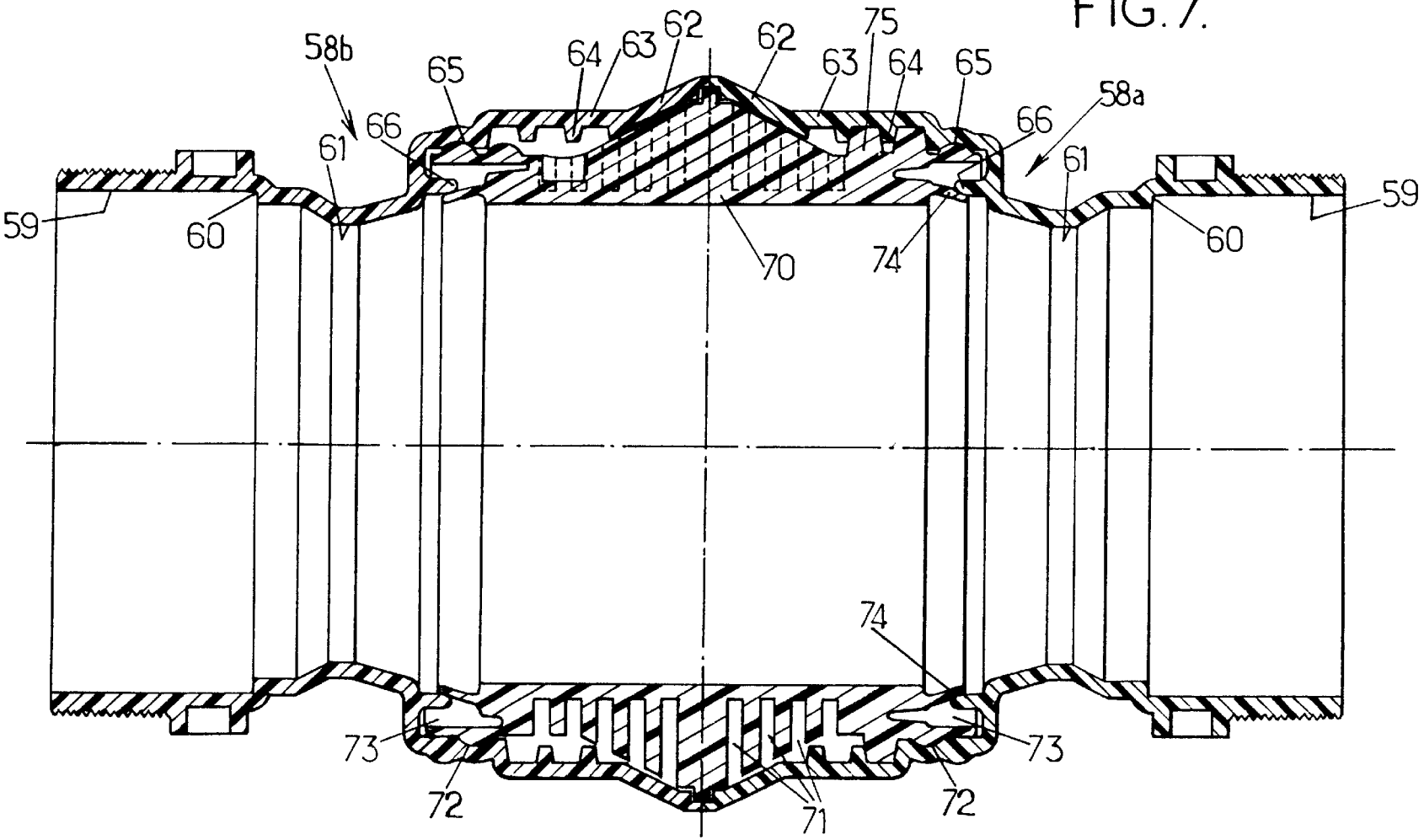
FIG. 7 is a section view showing another alternative embodiment of these means.

In the embodiment illustrated by FIG. 7, the two sleeves 58*a*, 58*b* are parts having the same shape:

- a cylindrical part 59 to receive the end of the sheath sections 10*a*, 10*b*;
- an internal shoulder 60 at the end of the cylindrical portion 59, against which abuts the end of the sheath section;
- a constriction 61 to fasten the sleeve to the positioning boss 16 on the wall 15 delimiting the front side of the mold, the coil spring 22 of the boss 16 engaging in the annular groove formed behind the constriction 61;
- a frusto-conical part 62 widening outwards and extending from the constriction 61 to the front end of the sleeve 58*a*, 58*b;*
- in the frusto-conical part 62, a cylindrical recess 63 provided with an internal threading 64 towards the front end of the sleeve, and with an annular groove 65, and the bottom of which comprises an annular rim 66 directed towards the front end.

The positioning and sealing joint 70 has a general shape complementary to that of the frusto-conical parts 62 and the cylindrical recesses 63 of the two opposite sleeves, with a central cylindrical bore having approximately the internal section of the sheath sections. To optimize the sealing, the joint 70 is provided with a series of radial notches 71 in the frusto-conical part of its external surface which makes it more flexible, with two annular ridges 72 which engage in the corresponding grooves 65 of the two sleeves and, on its two end faces, with two respective annular grooves 73 which enable a bending of the portions having the ridges 72 so that these engage resiliently in the grooves 65 of the sleeves, and which define, towards the inside of the joint, annular lips 74 being applied in a sealed manner against the annular rims 66 of the sleeves.

On only one of its sides, the joint 70 has a threading 75 intended to be screwed in the threading 64 of one of the sleeves. This screwing is carried out on the sleeve of the element made first, after its taking from the mold. On the opposite side of the joint 70, there is no threading 75, in order to enable the easy assembly of the elements.

The advantage of the embodiment of FIG. 7 is its lower cost considering the identity of the two sleeves 58*a*, 58*b* used.

What is claimed is:

1. A process of manufacturing concrete construction elements including at least first and second matched elements, the process comprising:

placing in a mold at least one first pre-stress sheath section having an end connected to a first sleeve applied against a wall of the mold, the first sleeve having an internal shape engaging a positioning boss placed on said wall;

pouring concrete into said mold so as to obtain the first element after setting of the concrete;

extracting the first element from the mold, whereby said first element has a contact face shaped by said wall;

constructing a second mold, whereby said second mold has one side consisting of said contact face of the first element;

placing in the second mold at least one second pre-stress sheath section having an end connected to a second sleeve held in position relative to the first sleeve by means of a positioning joint resiliently held in at least one of the first and second sleeves;

pouring concrete into the second mold so as to obtain the second element after setting of the concrete; and extracting the second element from the second mold, by disengaging the positioning joint from at least one of the first and second sleeves.

2. The process according to claim 1, wherein at least one of the first and second sleeves has an internal shape comprising an annular groove to receive a complementary annular ridge of the joint.

3. The process according to claim 1, wherein the positioning boss is provided with resilient coupling means for engaging with an annular groove present in the internal shape of the first sleeve in order to hold said first sleeve in a removable manner in the mold.

4. The process according to claim 1, wherein the sleeve in which the positioning joint is resiliently held has an angular opening of at least 30 degrees.

5. The process according to claim 1, wherein the positioning joint (30) is resiliently held in each one of the first and second sleeves.

6. The process according to claim 5, wherein the positioning joint has an orifice coaxial with the first and second sleeves extending therethrough, said orifice having a cross-section at least equal to an internal cross-section of the first and second sheath sections, and wherein the positioning joint is left in place in one of the first and second sleeves after the extraction of the second element.

7. The process according to claim 1, wherein the positioning joint is screwed into one of the first and second sleeves.

8. The process according to claim 1, wherein the first and second sleeves are parts having the same shape.

9. The process according to claim 1, wherein the positioning joint is integral with one of the first and second sleeves, and has an orifice coaxial with the first and second sleeves extending therethrough, said orifice having a cross-section at least equal to an internal cross-section of the first and second sheath sections.

10. The construction work comprising an assembly of prefabricated elements including at least first and second matched concrete elements having respective first and second contact faces of complementary shape, wherein the first and second matched concrete elements have a plurality of respective pre-stress sheath sections embedded therein, wherein each of said sheath sections embedded in said first element is connected to a respective first sleeve embedded in said first element at the first contact face, wherein each of said sheath sections embedded in said second element is connected to a respective second sleeve embedded in said second element at the second contact face, wherein the first and second contact faces are applied one against the other so that the first and second sheath sections are placed in an extension to one of the other to form complete sheaths, wherein joints are engaged in the sleeves in order to sealingly connect the adjacent sheath sections, and wherein pre-stressing cables and a filling product occupy the interior of the sheaths.

11. The construction work according to claim 10, wherein an adhesive is located at an interface between the first and second matched elements, whereby said sleeves and joints prevent said adhesive from penetrating into the sheaths.

12. The construction work according to claim 10, wherein at least one of the first and second sleeves has an internal shape comprising an annular groove to receive a complementary annular ridge of one of said joints.

13. The construction work according to claim 10, wherein each of said joints is screwed into one of the first and second sleeves.

14. The construction work according to claim 10, wherein the first and second sleeves are parts having the same shape.

15. The construction work according to claim 10, wherein each of said joints is integral with one of said first and the second sleeves, and has an orifice coaxial with the first and second sleeves extending therethrough, said orifice having a cross-section at least equal to an internal cross-section of the sheath sections.

* * * * *

UNITED STATES PATENT AND TRADEMARK OFFICE

CERTIFICATE OF CORRECTION

PATENT NO. : 6,389,764 B1
DATED : May 21, 2002
INVENTOR(S) : Stuber et al.

It is certified that error appears in the above-identified patent and that said Letters Patent is hereby corrected as shown below:

Column 5,
Line 51, after "joint" insert -- 30 --

Signed and Sealed this

Twenty-first Day of June, 2005

JON W. DUDAS
*Director of the United States Patent and Trademark Office*